United States Patent [19]

Golden

[11] Patent Number: 4,945,790

[45] Date of Patent: Aug. 7, 1990

[54] MULTI-PURPOSE HAND TOOL

[76] Inventor: Arthur Golden, 555 Hahaione St. #10, A, Honolulu, Hi. 96825

[21] Appl. No.: 390,295

[22] Filed: Aug. 7, 1989

[51] Int. Cl.[5] ..... B25B 23/00

[52] U.S. Cl. ..... 81/57.14; 81/437; 81/177.4

[58] Field of Search ..... 81/177.4, 490, 436, 81/437, 57.14; 7/138

[56] References Cited

U.S. PATENT DOCUMENTS 4,572,038 2/1986 Graham ..... 81/490 X 4,653,356 3/1987 Golden ..... 81/177.4 X

*Primary Examiner*—James G. Smith

*Attorney, Agent, or Firm*—Charles C. Logan, II

[57] ABSTRACT

A multi-purpose hand tool having novel structure that allows it to partially function in the manner of a revolver. It has a multi-chamber revolver-like cylinder which revolves and holds various sizes of screw drivers, Phillips head drivers, Allen wrenches, sockets, screw starters, etc. The tool has a primary shaft whose rear end is connected to the drive shaft of a D.C. electric motor mounted in the rear body assembly. The drive shaft passes through an aligned bore hole in the front body assembly that is mounted immediately behind the revolver-like cylinder. The rear body assembly is mounted in a track formed along the top edge of the handle assembly so that the rear body assembly may be reciprocally moved rearward to disengage the primary shaft from one driver tool to the next driver tool that the user desires to place on the end of the primary shaft. The front body assembly has been designed so it may be used in conjunction with the revolver-like cylinder in a manual operation by removing the front body assembly and attaching a ratchet handle assembly to its rear end. Various auxiliary assemblies can be detachably mounted to the hand tool.

11 Claims, 3 Drawing Sheets

X-AXIS
F
R

MULTI-PURPOSE HAND TOOL

BACKGROUND OF THE INVENTION

The invention relates to a hand tool used to tighten and loosen various types of fasteners. In the past hand tools generally have been single function tools such as a screw driver, or an Allen wrench. The advent of socket wrenches has allowed for the use of a single wrench to be used with multiple sized sockets. The drawback to this however remains in the fact it is still necessary to individually remove each female socket, place it back in its storage case, take a new female socket and attach it to the end of the socket wrench.

A few hand tools have been developed with multiple tool heads permanently attached to the fingers of a turret which is rotatable to allow each tool head to travel to a work position. An example of such a structure is illustrated in the Cunningham patents, U.S. Pat. Nos. 910,789 and 966,529. These tools have been primarily used in the watch making and repairing trade and have not been practical for general assembly work or repair work.

Another form of compact combination tool set is illustrated in U.S. Pat. No. 4,399,723. The inventor has stacked a number of tool heads and also provided structure on their lateral sides to provide additional ways of using a torqueing action. The applicant is the same inventor as U.S. Pat. No. 4,653,356. This patent is also directed to a multi-purpose hand tool.

It is an object of the invention to provide a novel multi-purpose hand tool having capabilities never previously available in the present state of the art hand tools.

It is also an object of the invention to provide a novel multi-purpose hand tool which has the flexibility to be operated by hand, or with a battery powered D.C. electric motor housed in the handle assembly.

It is another object of the invention to provide a novel multi-purpose hand tool which permits efficient and rapid changes of drivers and sockets thereby saving time and frustration.

It is an additional object of the invention to provide a novel multi-purpose hand tool which allows the tool heads to be removed as desired from the chambers of the revolving cylinder.

SUMMARY OF THE INVENTION

Applicant's novel hand tool has been designed to be a multi-purpose tool. Any variety of tool heads in the form of screw drivers, Phillips head drivers, Allen wrenches, sockets, screw starters, etc., can be utilized with this tool. Revolver-like cylinders, each having a plurality of recess chambers therein, can be preloaded with the driver tools that the user would be generally using in performing different assembly or disassembly operations. This permits efficient and rapid changes of the tool heads thereby saving time and frustration.

The multi-purpose hand tool has a primary drive shaft whose rear end is connected to the drive shaft of a D.C. electric motor mounted in the rear body assembly. Mounted adjacent the front end of the rear body assembly is the front body assembly which has an axially extending bore hole through which the primary drive shaft can freely travel. The revolver-like cylinder is rotatably secured to the forward end of the front body assembly. The bottom surface of the rear body assembly has a slide carriage structure attached to its base plate and the slide carriage is captured in a track that extends longitudinally along the top surface of the motor housing mounting portion of the hand assembly. The hand assembly has plurality of electric batteries mounted therein and they are connected by conventional electric circuitry through a switch on the handle to the D.C. electric motor.

The revolver-like cylinder has a plurality of recess chambers formed in its front face that align with apertures in its rear face. The recess chambers have longitudinally extending axes that are parallel to each other. These recesses have their axes on a common radius with the radius being substantially equal to the lateral distance from the longitudinal axis of the primary drive shaft to the longitudinal axis of the revolver-like cylinder. The revolver-like cylinder is manually rotatable about its longitudinal axis on a shaft extending from the front end of the front body assembly. A female socket having a tool head is positioned in each of the recess chambers of the cylinder. They are nominally held in position by retention pins that pass radially through the outer periphery of the cylinder. These retention pins have their tip removably engaged in the annular recess formed on each of the sockets. A coiled spring passes circumferentially around the perimeter of the cylinder and over top each of the individual retention pins to hold them in position. Forward movement of the primary drive shaft causes the particular retention pin to be pushed radially outwardly as it is disengaged from the socket as the driver tool is pushed longitudinally outwardly from the cylinder so that it may be used. The reciprocal travel of the primary drive shaft rearwardly results in the socket being reengaged by the retention pin and further rearward travel of the primary drive shaft causes the male socket head to be disengaged therefrom. This rearward travel of the primary drive shaft is the result of the rear body assembly being pulled rearwardly causing its slide carriage to travel along the track in which it is supported.

Once the desired driver tool has been chosen and the primary shaft is in its forwardly extended position, the user merely actuates the switch on the handle assembly to drive the primary shaft in a forward or a reverse direction. Sometimes the revolver-like cylinder has a couple sets of recesses in its front face at different radial distances. In this instance, the revolver-like cylinder may pulled downwardly in a reciprocal manner to operate the structure found at the forward end of the front body assembly. This results in changing the radial distance between the shaft of the cylinder and the longitudinal axis of the primary drive shaft. Any number of revolver-like cylinders may be preloaded with any desired driver tools so that the user has an infinite capacity of driver tools that may be easily positioned on the front end of his tool.

The front body assembly may be used apart from the handle assembly and the rear body assembly. When this occurs, a ratchet handle assembly is attached to the rear end of the primary drive shaft and the rest of the operation would be the same except that the rotational movement of the drive shaft would be manual rather than being driven by an electric motor.

An auxiliary light assembly may be attached to the top surface of the front body assembly. Also a utility storage box could be detachably mounted to the top wall of the front body assembly. The top wall of the front body assembly may also have a magnetic plate attached thereto for attracting screws or other fasteners that may be set thereon.

DESCRIPTION OF THE PREFERRED EMBODIMENT

Figures 1, 1A, 2, 3:
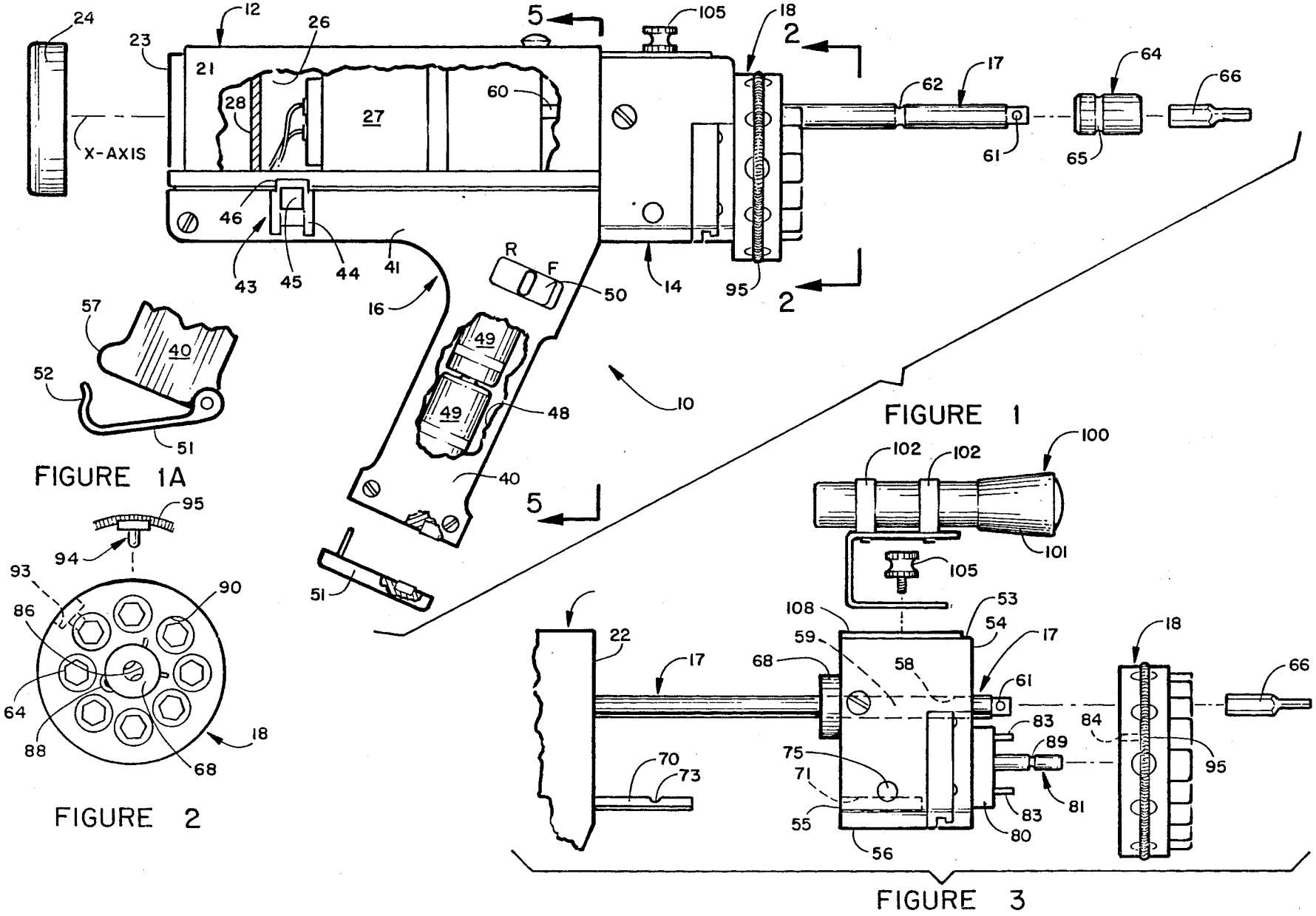
FIG. 1 is a side elevation view of applicant's novel multi-purose hand tool in an exploded view with portions broken away for clarity.
FIG. 1*a* is a partial side elevation view of the bottom of the handle portion showing a hinged cover structure.
FIG. 2 is an end elevation view taken along lines 2—2 of FIG. 1.
FIG. 3 is an exploded side elevation view of the forward portion of FIG. 1.

Applicant's novel multi-purpose hand tool will now be described by referring to FIGS. 1–8 of the drawings. The multi-purpose hand tool is generally designated numeral 10. It has a rear body assembly 12, a front body assembly 14, a handle assembly 16, and a revolver-like cylinder 18.

Figure 5:
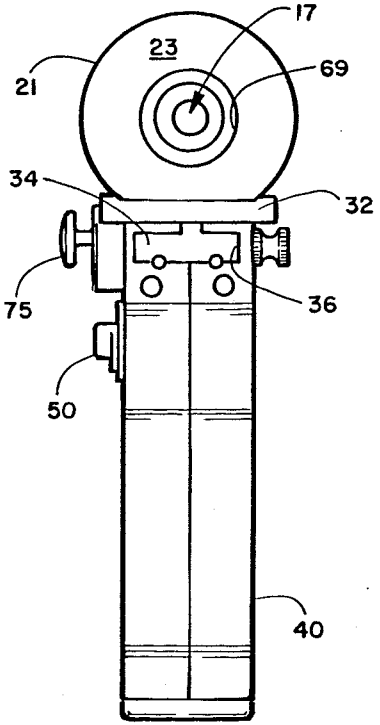
FIG. 5 is a front elevational view taken along lines 5—5 of FIG. 1.

Rear body assembly 12 is best described by referring to FIG. 1. It has a cylindrical housing 21 having a front end 22 and an open rear end 23. An end cap 24 is detachably removable from end wall 23. A compartment 26 is formed within cylindrical housing 21 and a D.C. electric motor 27 is mounted therein. A wall 28 forms a storage chamber 29 in the rear end of cylindrical housing 21. Referring to FIG. 5, it will be noted that a base plate 32 is formed on the bottom surface of cylindrical housing 21 and it has a slide carriage 34 attached to its underside. Slide carriage 34 is captured in a track channel 36 formed in handle assembly 16. The plurality of ball bearings 38 provide for smooth easy travel of the slide carriage 34.

Handle assembly 16 has a handle portion, and a motor housing mounting portion 41. It is along the top surface of motor housing mounting portion 41 that slide track 36 is formed. A motor housing release assembly 43 functions to lock the axial travel of rear body assembly 12 with respect to handle assembly 16. Motor housing release assembly 43 has a stationary bracket 44 and a slidable finger 45. Slidable finger 45 is detachably engaged in a notch 46 along the side edge of base plate 32.

Handle portion 40 has a battery chamber 48 formed therein that is connected in a conventional circuit by electrical wires to D. C. electric motor 27 and switch 50. The bottom end of handle portion 40 has a hinged cover 51. An alternative hinged cover 51 prime is pivotally attached to the bottom end of handle portion 40 prime and this structure is illustrated in FIG. 1*a* hinged cover 51 prime has a curved lip 52 prime that detachably engages protrusion 57 prime.

Figure 4:
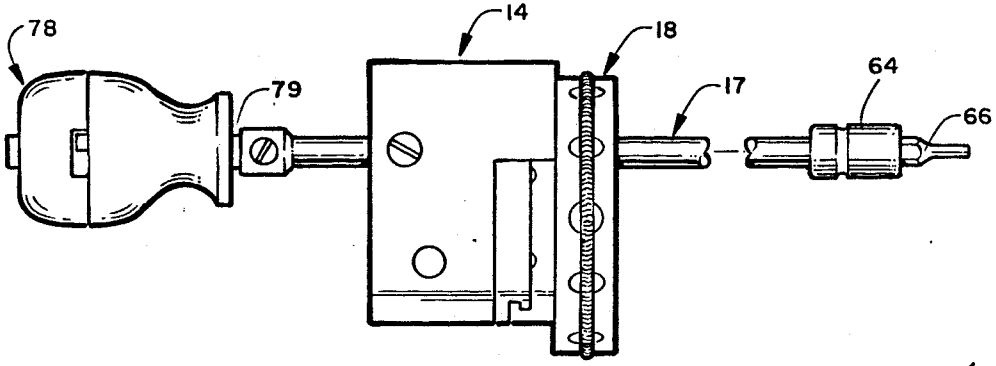
FIG. 4 is a side elevation view illustrating the manner in which the multi-purpose hand tool may be manually used.
Figure 7:
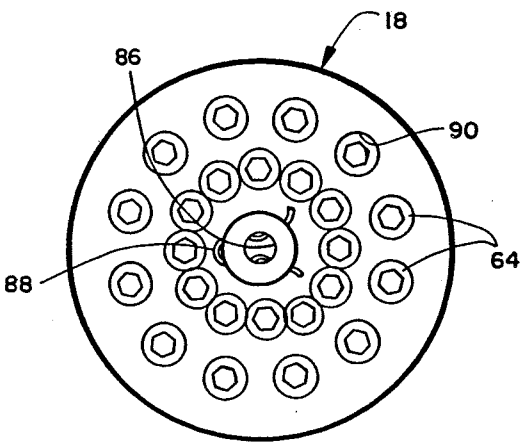
FIG. 7 is a front elevation view of an alternative revolver-like cylinder.
Figure 6:
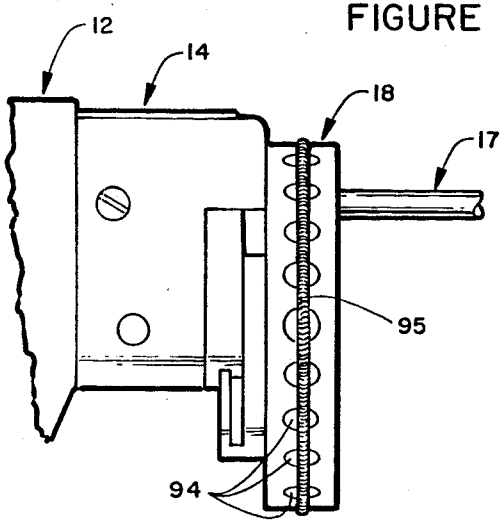
FIG. 6 is a partial side elevation view illustrating the revolver-like cylinder moved vertically downwardly with respect to the front wall of the front body assembly.

Front body assembly 14 is best illustrated in FIGS. 1 and 3. It has a top wall 53, a front wall 54, a rear wall 55, and a bottom wall 56. A bore hole 58 passes from rear wall 55 through to front wall 54 and primary drive shaft 17 passes freely therethrough. The rear end of primary drive shaft 17 is connected to motor drive shaft 60. The front end of driveshaft 17 has a male socket head 61 and an annular recess is 62 spaced rearwardly therefrom. Sockets 64 each have a recess formed in their respective front and rear ends for receiving the drive tools 66 and the male socket head 61. The rear wall 55 of front body assembly 14 has an annular boss member 68 extending outwardly therefrom that mates with a boss recess 69 formed in the front end 22 of rear body assembly 12. A pair of horizontally spaced alignment and release pins 70 extend from front end wall 22 and they are received in bores 71 formed in rear wall 55. A horizontal groove 73 extends transversely to alignment and release pin 70 and it cooperates with release button 75 to disengage front body assembly 14 from rear body assembly 12. When separated, front body assembly 14 can be used with a ratchet handle assembly 78 such as illustrated in FIG. 4. The rear end of primary shaft 17 is secured to male socket head 79 to provide a manually operable tool.

Figure 9:
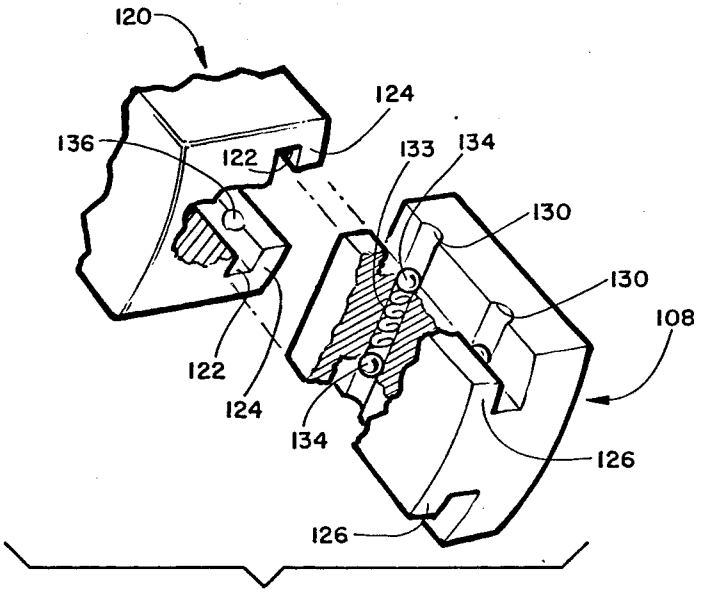
FIG. 9 is a partial exploded perspective view of the bottom end of the front mounting body block and the adjustable carriage portion.
Figure 11:
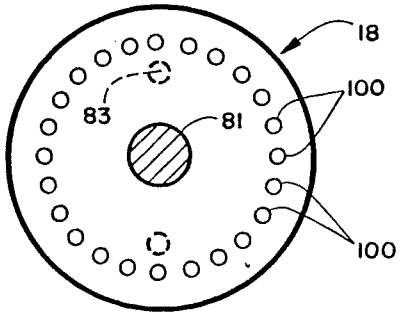
FIG. 11 is a view taken along lines 11—11 of FIG. 10.
Figure 10:
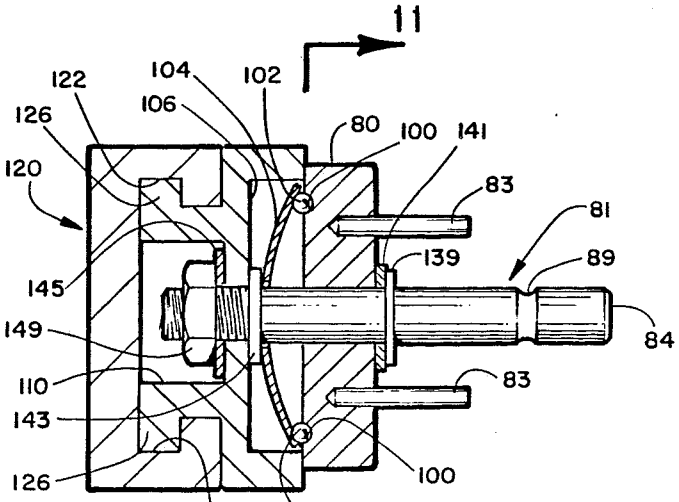
FIG. 10 is a horizontal cross sectional view taken through the front body mounting block and the adjustable carriage portion.

Front wall 54 of front body assembly 14 has a rotatable cylindrical boss 80 extending forwardly therefrom and it has a secondary shaft 81 journaled therein. A pair of registration pins 83 also extend forwardly therefrom and they are received in aligned bore holes 84 in the rear wall of revolver-like cylinder 18 that is rotatable about secondary shaft 81. A bore hole 86 (see FIG. 2) is found in cylinder 18 and the tip of secondary shaft 81 passes therethrough until it is captured by cylinder retention pin 88 in annular recess 89. A plurality of socket recesses 90 are formed in the front face of cylinder 18 and sockets 64 are detachably engaged therein. The manner in which the revolver-like cylinder 18 manually is rotated to have positive incremental advancements so that the socket adapters align with male socket head 61 is best understood by referring to FIGS. 10 and 11. The rear face of cylindrical boss 80 has a plurality of detents 100 arranged in a circular pattern. A pair of ball bearings 102 are forced into the aligned detents by spring 104 that is captured in recess 106 of adjustable carriage portion 108. Counterbore 110 receives the threaded tip of secondary shaft 81 that passes through bore 112 of cylindrical boss 80. A washer 145 and a nut 149 secure the rear end of secondary shaft 81. There is a flange or washer 143 rigidly secured to secondary shaft 81. A washer 141 and a snap ring 139 prevents cylindrical boss 80 from separating from adjustable carriage portion 108. When revolver-like cylinder 18 has socket adapters located in its front face that are positioned on different radius's of the revolver-like cylinder, adjustable carriage portion 108 can be adjusted to one of its various vertical positions thereby aligning the desired socket adapter with the male socket head 61. The structure that makes this possible is best understood by referring to FIGS. 9 and 10. Front body mounting block 120 is attached to the front body assembly 14 by screws. Front body mounting block 120 has tracking channels 122 and inwardly extending flanges 124. Captured within these tracking channels are the flanges 126 of adjustable carriage portion 108. Extending transversly through adjusted carriage portion 108 are a pair of bore holes 130 and an expansion spring 133 is captured therein with a ball bearing 134 on either of its ends. The ball bearings 134 are naturally forced into recesses 136 in front body mounting block 120. There are a pair of recesses 136 that establish an upper position for the adjustable carriage portion 108 and a lower set of recesses 136 establish the lower position for adjustable carriage portion 108. The upper position aligns the socket adapters positioned at one radius of the revolver like cylinder and the lower position aligns the sockets adapters at the other radial position.

The manner in which sockets 64 are captured in recesses 90 will be described by referring to FIGS. 2 and 3. Retention pin apertures 93 are spaced radially around the outer side wall surface of cylinder 18. A plurality of retention pins 94 are captured in these apertures and held in place by a coiled spring 95 passing around the outer perimeter of cylinder 18. The spring tension of coil spring 95 keeps the tip of the retention pins in forced engagement against annular recesses 65 of the individual sockets 64. When sufficient forward force is pushed on primary drive shaft 17, the individual socket 64 will cause the retention pin 94 to travel radially outwardly to the point where it is disengaged. When the socket 64 is brought back into its respective recess 90, retention pin 94 will drop back into annular recess 65.

A light assembly 200 may be detachably secured to the top wall 53 of front body assembly 14. It has a flashlight unit 201 that is held by retainer brackets 202 whose ends are captured in mounting bracket 204. Screw 105 is removably threaded into a threaded bore in magnetic plate 208.

Figure 8:
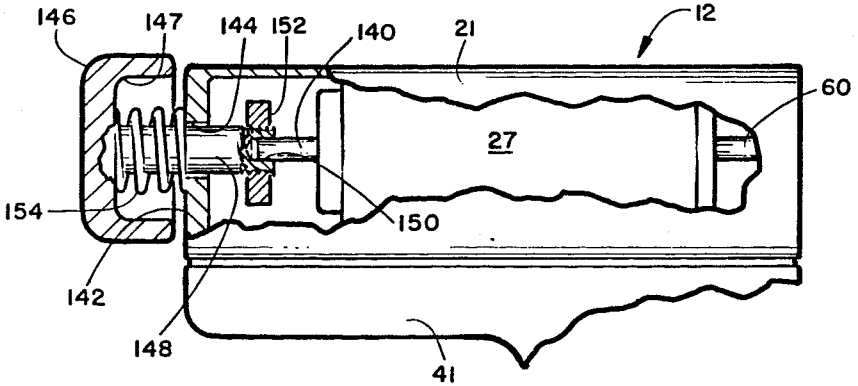
FIG. 8 shows an alternative embodiment that uses a D.C. electric motor having a shaft extending from each of its ends.

In FIG. 8, an alternative motor housing 12' is detachably secured to motor housing mounting portion 41. A double shafted motor 27' is positioned within motor housing 12' and it has a front shaft 60' and a rear shaft 140. The rear wall 142 of cylindrical housing 21' has an aperture 144 formed therein. End cap 146 has a recess 147 having a cylindrical member 148 extending therefrom. The front end of cylindrical member 148 has a recess 15 for receiving the end of rear shaft 140. A limit ring 152 is secured to the outer end of cylindrical member 148. A spring 154 functions to keep the end cap 146 normally spaced from rear wall 142. When end cap 146 is pressed forwardly, it will allow the recess 150 to engage the rear shaft 140 so that fine tune alignment of the front shaft 60' can be made with the socket adapters.

What is claimed is:

1. A multi-purpose hand tool comprising:

an elongated rear body assembly having a longitudinally extending axis, said rear body assembly having a front end, a rear end, a top surface and a bottom surface, a compartment is formed in said rear body assembly and a D. C. electric motor is mounted therein and it has at least one drive shaft extending from one of its ends;

an elongated primary shaft having a predetermined length and having a front end and a rear end;

means for connecting said driveshaft to the rear end of said primary shaft so that said primary shaft can be rotated;

a handle assembly having a rear body assembly mounting portion and a handle portion, said rear body assembly having means on its bottom surface that mates with means on the top surface of the rear body assembly portion of said handle assembly that allows said rear body assembly to be reciprocally slid along the top surface of said mounting portion which allows the front end of said primary shaft to be withdrawn rearwardly from said revolver-like cylinder;

a front body assembly having a front wall, a rear wall, a top wall, and a pair of laterally spaced side walls, a bore hole extending from said front wall to said rear wall and being of a diameter such that said primary shaft freely passes therethrough;

means for detachably securing said front body assembly to the front end of said rear body assembly;

a revolver-like cylinder having a longitudinally extending axis, said cylinder having a front face and rear face, said cylinder having a first set of recesses formed in its front face that align with apertures in said rear face, said first set of recesses having longitudinally extending axes that are parallel to each other, said first set of recesses having their axes on a first common radius, said first common radius being substantially equal to the lateral distance from the longitudinal axis of said primary shaft to the axis of said cylinder; and means for rotatably connecting said cylinder to the front wall of said front body assembly.

2. A multi-purpose hand tool as recited in claim 1 further comprising said revolver-like cylinder having a second set of recesses formed in its front face and these align with apertures in said rear face, said second set of recesses having longitudinally extending axes that are parallel to each other, said second set of receses having their axes on a second common radius, means for adjusting the vertical height of said cylinder with respect to the front face of said front body member so that said second common radius is in alignment with the longitiudinal axis of said primary shaft.

3. A multi-purpose hand tool as recited in claim 1 further comprising a flashlight assembly detachably mounted on the top wall of said front body assembly.

4. A multi-purpose hand tool as recited in claim 1 further comprising magnetic structure on the top wall of said front body assembly.

5. A multi-purpose hand tool as recited in claim 1 wherein said handle has a bottom end that has an openable cover that is in communication with a battery chamber formed in said handle.

6. A multi-purpose hand tool as recited in claim 5 further comprising a plurality of batteries mounted in said chamber, a switch is mounted on the outside surface of said handle portion and a plurality of electrical wires are connected to said batteries, said switch and said D. C. electric motor to form a complete circuit.

7. A multi-purpose hand tool as recited in claim 7 further comprising means for locking said rear body assembly in a fixed position with regard to the rear body mounting portion of said handle.

8. A multi-purpose hand tool as recited in claim 7 further comprising means for locking said front body assembly to said rear body assembly.

9. A multi-purpose hand tool as recited in claim 7 wherein said D. C. electric motor has a drive shaft extending from both its front end and its rear end.

10. A multi-purpose hand tool as recited in claim 1 further comprising means for positively positioning the axes of said recesses in alignment with the longitudinal axis of said primary shaft.

11. A multi-purpose hand tool as recited in claim 7 wherein said means for rotatably connecting said cylinder to said front wall of said front body assembly comprises a secondary shaft that extends outwardly from said front wall and there is quick release spring means in the longitudinally extending axis of said revolver-like cylinder so that it may be quickly changed.

* * * * *